United States Patent [19]

Rowan et al.

[11] Patent Number: 4,851,172

[45] Date of Patent: Jul. 25, 1989

[54] PROCESS FOR HIGH SPEED, MULTI-END POLYESTER HIGH PERFORMANCE TIRE AND INDUSTRIAL YARN

[75] Inventors: Hugh H. Rowan, Chapel Hill; James G. Neal, Raleigh, both of N.C.

[73] Assignee: Allied-Signal Inc., Morris Township, N.J.

[21] Appl. No.: 258,281

[22] Filed: Oct. 13, 1988

Related U.S. Application Data

[63] Continuation-in-part of Ser. No. 642,982, Aug. 21, 1984, abandoned.

[51] Int. Cl.[4] ..... D01D 5/12

[52] U.S. Cl. ..... 264/130; 264/210.2; 264/210.5; 264/210.7; 264/210.8; 264/211.15; 264/211.17; 264/290.5

[58] Field of Search ..... 264/210.7, 210.8, 130, 264/210.2, 210.5, 211.15, 211.17, 290.5

[56] References Cited

U.S. PATENT DOCUMENTS

| | | | |
|---|---|---|---|
| 3,495,295 | 2/1970 | Farrand et al. | 264/290.5 |
| 3,698,614 | 10/1972 | Mohr et al. | 264/121.4 |
| 3,715,421 | 2/1973 | Martin et al. | 264/210.7 |
| 4,251,481 | 2/1981 | Hamlyn | 264/210.8 |
| 4,349,501 | 9/1982 | Hamlyn | 264/210.8 |
| 4,414,169 | 11/1983 | McClary | 264/210.8 |

FOREIGN PATENT DOCUMENTS

| | | | |
|---|---|---|---|
| 50-25819 | 3/1975 | Japan | 264/210.8 |

*Primary Examiner*—Hubert Lorin
*Attorney, Agent, or Firm*—William H. Thrower

[57] ABSTRACT

An improvement in a high speed process to produce high performance multi-end polyester yarn comprises extruding molten polyester from a spinnerette to form filaments, then cooling, lubricating and advancing the filaments to a forwarding roll system at the speed of from about 1000–4000 meters per minute so that a partially oriented yarn is produced, then feeding the filaments from the forwarding roll system to a first draw roll system to partially draw the yarn, then feeding the paritally drawn yarn to a second draw roll system having a draw point localizing device then feeding the filaments from the draw roll system to a conditioning roll system and finally taking up the filaments. The improvement is the use of matte finish on godet rolls having an arithmetic mean roll surface roughness value of from between about 35 microinches and about 120 microinches to feed and withdraw yarn to and from a draw point localizing device in the second draw roll system. This combination enables multiple ends of the filaments to be advanced through a single set of forwarding, drawing and conditioning rolls and yarn mechanical quality remains at a high level of acceptance.

12 Claims, 1 Drawing Sheet

PROCESS FOR HIGH SPEED, MULTI-END POLYESTER HIGH PERFORMANCE TIRE AND INDUSTRIAL YARN

This is a continuation-in-part of copending U.S. Ser. No. 642,982 filed Aug. 21, 1984, now abandoned.

This invention is related to an improved process for high speed, multi-end polyester high performance tire and industrial yarn wherein partially oriented polyester yarn is drawn in two stages at high speed using matte finish godet rolls and a draw point localizing device in the second draw zone, conditioned and taken up.

High speed processing of partially oriented polyester yarn is disclosed in U.S. Pat. No. 4,414,169 to McClary, hereby incorporated by reference. Matte finish draw rolls are disclosed in U.S. Pat. No. 3,968,614 to Mohr et al. and U.S. Pat. No. 3,495,295 to Farrand et al., both hereby incorporated by reference. An apparatus similar to that used for this invention is disclosed in U.S. Pat. No. 4,251,481 to Hamlyn, hereby incorporated by reference.

SUMMARY OF THE INVENTION

This invention is an improvement in a high speed process to produce high performance multi-end polyester tire and industrial yarn. That process comprises (a) extruding molten polyester from a spinnerette to form filaments, then (b) cooling, lubricating and advancing the filaments to a first forwarding roll system at a speed of from about 1000 to 4000 meters per minute so that a partially oriented yarn is produced, then (c) feeding the filaments so that the filaments are partially drawn from the forwarding roll system to a first draw roll system, then (d) feeding the partially drawn filaments from the first draw roll system to a second draw roll system having a draw point localizing device, such as a steam jet, hot air jet, or infrared localizer, then (e) feeding the filaments from the second draw roll system to a conditioning roll system and finally (f) taking up said filaments. The improvement comprises use of matte finish godet rolls having an arthrimetic mean roll surface roughness value of from between about 35 microinches to about 120 microinches to feed and withdraw yarn to and from a draw point localizing device in the second draw roll system so that the tension in the second draw roll system is reduced to below 5 gpd, preferably 4 gpd or less, most preferably below 3.5 gpd and more than one end of the filaments can be advanced through a single set of forwarding, drawing and conditioning rolls and yarn mechanical quality remains at a high level of acceptance. The preferred roughness value for the rolls is between about 35 and about 80 microinches. The preferred draw roll system is four matte finish godet rolls paired in a first pair to feed the draw point localizing device, and a second pair to withdraw yarn from the draw point localizing device. It is preferred to maintain the first pair of draw rolls at a temperature of from between 50° to about 100° C., and the second pair of draw rolls at a temperature of from between about 200° to 237° C. The preferred conditioning roll system is a pair of godet rolls maintained at a temperature of from about 140° to 160° C. Also, it is preferred that the conditioning rolls have an arithmetic mean roll surface roughness value of from between about 35 and 120 microinches. Even more preferred is a roughness value of between about 35 and 80 microinches for the conditioning rolls. The preferred temperature when the draw point localizing device is a steam jet is between about 320° and 520° C. steam temperature and the preferred yarn speed on the first forwarding yarn system is about 1200 and 3000 meters per minute. The preferred roughness value for the first forwarding roll system is a value from between about 2 and 8 microinches. Finally, it is preferred that the yarn relax from between about 1 to 10 percent on the conditioning roll system. By draw point localizing device is meant any high speed localizing device such as a steam jet, hot air jet, other hot fluid jets, infrared localizer devices and the like. Devices which contact yarn, such as heated plates, snubbing pins and the like will not operate at the high speeds of this invention. Yarn would instantly or constantly break at high speeds.

DESCRIPTION OF PREFERRED EMBODIMENT

Figure 1:
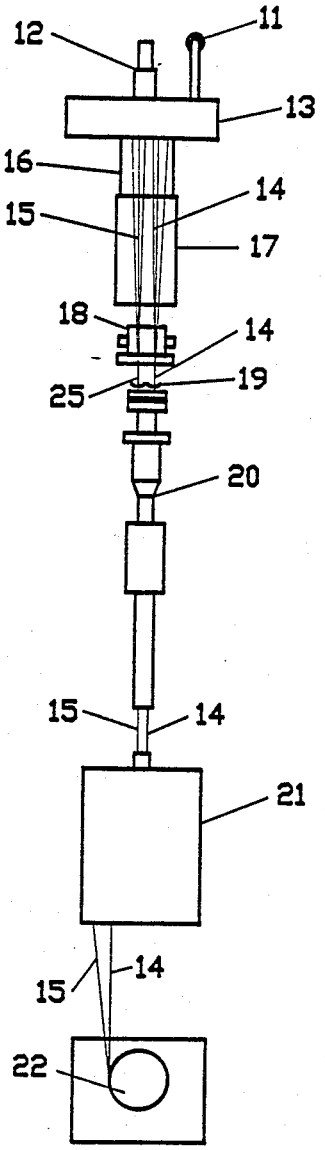
FIG. 1 is a schematic front view of the apparatus used for the method of this invention.
Figure 2:
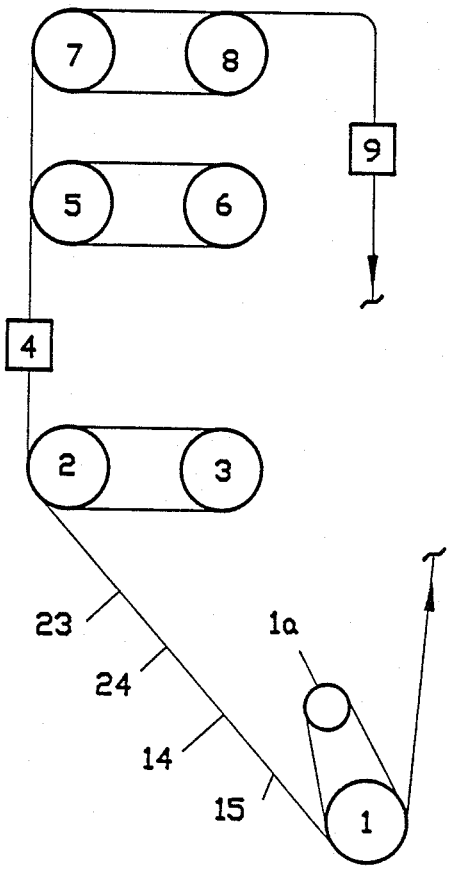
FIG. 2 is a schematic front view of the draw panel of this invention designated No. 21 in FIG. 1.

Referring to FIGS. 1 and 2, like numbers indicate like apparatus. Molten polymer is fed by extruder 11 to spin pump 12 which feeds spin block 13 containing a spin pot, not shown, disclosed in pending application U.S. Ser. No. 634,737 filed July 26, 1984, including a spinnerette and a spinning filter disposed between the spin pump and spinnerette. The spinnerette is designed for the extrusion of one or more ends of filaments. FIG. 1 illustrates the simultaneous extrusion of two ends 14 and 15 of multifilament, continuous filament yarn from one spinnerette. Ends 14 and 15 are extruded from the spinnerette at a rate of 35 to 75 pounds (16 to 34 kg) per hour per end, and are passed downwardly from the spinnerette into a quiescent chamber 16, most preferably about 2.2 inches (5.7 cm). The extrusion rate, of course, will differ depending on the denier and number of ends of yarn being extruded. For instance, a single continuous end of 1000 denier would be extruded from the spinnerette at a rate of about 35 to 75 pounds (16 to 34 kg) per hour, most preferably 60 pounds (27 kg) per hour, while two continuous ends would be extruded from the spinnerette at a rate of about 70 to 150 pounds (48.3 to 103.5 kg) per hour, most preferably at a rate of 120 pounds (54 kg) per hour. Four end rates would be double the two end rates. Yarn leaving chamber 16 is passed directly into the top of the quench chamber of conventional radial inflow quenching apparatus 17. The quench chamber is an elongated chimney of conventional length, preferably from 8 to 46 inches (0.2 to 1.2 meters). Ends 14 and 15 of yarn are lubricated by finish applicator 18 and then the ends are separated and the filaments in each end converged by guides 19. A conventional spinning finish composition is used to lubricate the filaments. Finish applicator 18 is depicted as a lube roll which is rotated with the direction of the yarn movement. Rotation of the lube roll is at a rate of about 1.5 to 5 revolutions per minute, typically 3.1 revolutions per minute, for a lube roll having a diameter of about 3 to 8 inches (7.62 to 20.3 cm), typically 6 inches (15.2 cm). It is preferred that the filaments be coated with from about 0.2 to about 1.0 weight percent based on the weight of the yarn of the finish, most preferably 0.4 percent. Ends 14 and 15 are then transported via interfloor tube and aspirator 20 to spin draw panel 21 (see FIG. 2) where they are fed to wrap around first forwarding roll 1 and accompanying separator roll 1*a*. Ends 23 and 24, shown in FIG. 2, may be produced from a second spinnerette and quench as described above, or produced in the same spinnerette of special design. Yarn ends are then fed to draw roll 2 and accompanying roll 3. From draw roll 2, the ends are then passed through conventional steam impinging draw point localizing steam jet 4 supplying steam at a temperature of about 320° C. to 520° C. and at a pressure of about 60 to 125 psig (41.4 to 86.3 newtons/cm$^2$) and then to a pair of draw rolls 5 and 6. The ends pass from draw rolls 5 and 6 to conditioning roll 7 and accompanying roll 8. The yarn ends then pass through a conventional air operated interlacing jet 9 and are taken up by winder 22. In FIG. 2, ends 14, 15, 23 and 24 are all processed on the same single set of forwarding (first roll 1), drawing (rolls 2–3 and rolls 5–6) and relaxing rolls (rolls 7–8). Ends 23 and 24 can be visualized as being behind ends 14 and 15 in FIG. 1.

With respect to conditions for operating the apparatus of this invention, the undrawn yarn birefringence is equal to or greater than 0.027, intrinsic viscosity of the yarn produced is between 0.85 and 0.98, and the denier per filament between 2.5 and 5.2, other characteristics are given in the examples following. Takeup speed at the winder would range between 3200 and 6000 meters per minute and the speed at the pretension roll 1 will vary between about 1000 and 4000 meters per minute, preferably between about 1000 and 2400 meters per minute. The draw ratio in the first stage between roll 1 and roll 2 can be between 1.5 and 2.5 to 1, preferably 1.73 to 1. The draw tension in the first draw zone is between 500–3000 grams, preferably 800 grams. The draw ratio in the second draw zone is between 1.3 and 1.7 to 1, preferably 1.42 to 1 across draw point localizing steam jet 4. The draw tension in the second draw zone is between 2500–4000 grams, preferably 3000 grams. Drawing of partially oriented polyethylene terephthalate fibers with matte rolls, but without a draw point localizing device, produces drawn yarn with desirable physical properties and good mechanical quality, but with very high draw tension between 5000–6000 grams.

The tensions provided above for draw zones one and two are for 1000 denier yarn. It will be understood that for yarns of different denier, the tensions will vary proportionally. However, the tensions expressed in grams per denier will be similar. For the second zone tension expressed above, the range is 2.5 to 4 grams per denier. In broadest terms, the maximum tension in the system is reduced to below 5 grams per denier, preferably 4 grams per denier or less, most preferably below 3.5 grams per denier.

Drawing is not completely localized and begins on the forwarding roll. The use of a draw point localizing jet is well known to reduce draw tension. In previous processes both forwarding and draw rolls with smooth surface finishes were used in order to prevent yarn slippage and to isolate the drawing within the draw point localizer. In this invention it has been surprisingly found that a conventional draw point localizing steam jet can be used to reduce draw tension without completely localizing the drawing while producing yarn with superior mechanical quality. This will enable more than one end of yarn to be drawn through a single set of forwarding, drawing and conditioning rolls. It was previously thought that the matte finish rolls would render a draw point localizing device, such as a steam jet, inoperative because the draw point would fluctuate in and out of the device. However, surprisingly, the use of matte finish rolls does not render the draw point localizing device inoperative, even though some drawing takes place away from the device. Yarn relaxes 1 to 10 percent between rolls 5 and 7, preferably 1 to 3 percent. The tension of the yarn is 1.5 grams per denier when introduced to the first conditioning roll 7, and decreases to a takeup tension of 0.15 to 0.25 gram per denier while on conditioning rolls 7 and 8. The yarn will relax another 1.5 to 2 percent between roll 8 and winder 22. Surface finish values (Ra) on rolls 2, 3, 5, 6, 7, and 8 can be between about 35 to 120 microinches, preferably 35 to 80 microinches, and most preferably about 60 microinches. These are the matte finish rolls. However, roll 1 is a mirror finish smooth roll having an arithmetic mean roll surface roughness value (Ra) of between 2 and 10, preferably between 2 and 8, and most preferably about 5 microinches. The temperature conditions for rolls 1, 2, 3, 5, 6, 7 and 8 are given in Table 1. If temperature on rolls 2 and 3 rises above 100° C., the final yarn tenacity and mechanical quality is diminished. On draw rolls 5 and 6, if temperature is below 200° C., tenacity is diminished in the final product and when temperature exceeds about 237° C., the yarn starts sticking to the rolls causing wraps. This upper temperature has the same effect on conditioning rolls 7 and 8. However, on rolls 7 and 8 it has been found that 140° C. is the lowest temperature that can be used to obtain yarn with desirable physical properties. On the matte rolls the roll surface roughness value is typically 60 but can be between 35 and 120, but preferably between 35 and 80 microinches. Below 35 microinches the desired effect of producing yarn with excellent mechanical quality is lost. Regarding the draw point localizer jet, typical steam temperature is 420° C. with a broad range of 320° to 520° C. and a preferred range of 375° to 450° C. Regarding the yarn speed on the first roll (roll 1), typical speed is 1600 meters per minute with a broad range of 1000 to 4000 meters per minute, the preferred range of 1200 to 3000 meters per minute and below 1000 meters per minute the preferred partially oriented yarn characteristics of the yarn being drawn in the quench stack is not achieved. Roughness values are measured by a Bendix Profilometer Type VE Model 14. The preferred embodiment of feeding multiple ends of yarn to the panel would be from air bearing guide roll(s) at the exit of the interfloor tube(s).

TABLE 1

| | Roll Number | | | |
|---|---|---|---|---|
| | 1 | 2 and 3 | 5 and 6 | 7 and 8 |
| Broad, °C. | 50–120 | <100 | 200–240 | 140–237 |
| Preferred, °C. | 80–100 | 50–100 | 200–237 | 140–160 |
| Target, °C. | 90 | 60 | 220 | 150 |

COMPARATIVE EXAMPLE 1

(Smooth Rolls and Draw Point Localizing)

A pilot plant yarn forwarding and drawing panel of six godet rolls arranged as in FIG. 2 but with rolls 1 and 1*a* replaced by a single guide roll and draw point localizing steam jet (d.p.l.) 4 moved to between rolls 5 and 7 was used to produce yarn with normal physical properties but poor mechanical quality. A single end of polyester tire yarn of 0.85 intrinsic viscosity (i.v.) was run on the pilot plant apparatus as in FIGS. 1 and 2 at 45.3 pounds per hour (20.6 kg/hr) at take-up at the winder of 3000 m/m and steam jet pressure of 60 psig (41/4 newtons/cm$^2$) and steam temperature of 400° C. The rolls labeled 2–8 were smooth rolls with an arithmetic mean average surface roughness ($R_a$) value of 2–8 microinches. The second stage draw tension was 2900 grams. Other conditions and yarn properties are given in Table II. Based on visual inspection, this yarn contained numerous broken filaments and loops and was judged to be of substandard mechanical quality and unfit to process into cord for tire reinforcement.

COMPARATIVE EXAMPLE 2

(Some Matte Rolls—No Draw Point Localizing)

The roll shells on the pilot plant forwarding and drawing panel labeled 5–8 were replaced with matte roll shells. The rolls had $R_a$ values as follows: rolls 2 and 3 smooth finish; roll 5, 35 to 43; roll 6, 44 to 53; roll 7, 63 to 66; and roll 8, 70 to 77. The steam was turned off to the draw point localizing steam jet. A single end of polyester tire yarn of about 0.85 i.v. was run at 36.8 lbs/hr (16.7 kg/hr) at take-up at the winder of 2528 m/m. Other conditions and yarn properties are given in Table III. Defects were measured with a Toray Fray Counter Model DT-104 which operates in a manner similar to a Lindley defect counter by sensing yarn loops and broken filaments with an optical-electric mechanism. The Toray instrument weas positioned between roll 8 and the winder, and defects were counted while the yarn was produced. First quality commercial yarn measured about 6–12 defects/1000 meters when tested with the Toray apparatus. Table III shows that yarn with excellent mechanical quality was produced with an average of only 3.2 defects/1000 meters. Second stage draw tension exceeded the limit (5000 grams) of the measuring device. The estimated tension was 6000 grams which would prohibit the drawing of multiple ends through a single set of rolls.

COMPARATIVE EXAMPLE 3

(Smooth Feed, Matte dpl Withdrawal Rolls)

The pilot plant forwarding and drawing panel was again modified to the arrangement as shown in FIG. 2 except roll 3 was replaced with an air bearing separator roll. Roll surfaces were the same as in Example 2. The steam jet was moved to between roll pairs 2/3 and 5/6. A single end of polyester yarn of about 0.85 i.v. weas processed at 41.4 pounds/hour (18.8 kg/hr), a take-up speed of 2751 m/m and steam jet pressure of 80 psig (55.1 newtons/cm$^2$). Second stage draw tension and defects measured at various steam jet temperatures are shown in Table IV. As can be seen, a high defect level was found in the yarn produced due to use of a smooth finish godet roll to feed the dpl steam jet.

EXAMPLE 4

The pilot plant forwarding and drawing penal is again modified to the measurement of Example 1. Rolls 1 and 1*a* are replaced by a single guide roll and dpl steam jet 4 moved to between rolls 5 and 7. A single end of polyester tire yarn of about 0.85 i.v. is run on the pilot plant apparatus at 36.8 pounds/hour (16.7 kg/hr) at take-up speed at the winder of 2543 m/m and steam jet pressure 60 psig (41.4 newtons/cm$^2$). Table V includes second stage draw tension and defects measured at various steam jet temperatures. The rolls labeled 2 and 3 in FIG. 2 are smooth rolls with an arithmetic mean average surface roughness value ($R_a$) of 5+3. The other rolls have $R_a$ values as follows: roll 5, 35 to 43; roll 6, 44 to 53; roll 7, 63 to 66; and roll 8, 70 to 77. Other conditions are the target and preferred conditions given above. Thus, by use of matte finish rolls both feed and withdrawing yarn from the dpl steam jet second stage draw zone, very high quality low defect yarn is produced. Prior thinking was that the low friction matte finish rolls could not be used to feed and withdraw yarn from a steam jet because the steam jet would reduce the length of the draw zone and slippage would allow the actual draw zone to fluctuate, thus causing unstable, inconsistent drawing and yarn conditions. However, surprisingly, the draw zone is not critical and the yarn had superior defect levels and normal physical properties.

EXAMPLE 5

Using the apparatus shown in FIGS. 1 and 2 but with two ends of polyester yarn at 114.3 pounds/hour (52 kg/hr) and a speed of 1650 m/m at roll 1 and take-up speed of 3889 m/m, yarn was produced under the conditions given in Table VI to produce yarn of properties given in Table VII. Any conditions not given in Table V are the target or preferred conditions given above in the Description of Preferred Embodiment.

Table I

Process Conditions

TABLE I

| Process Conditions | |
|---|---|
| Yarn denier | 1000 |
| Filaments | 290 |
| Thruput | 51.8 kg/hr |
| Polymer temperature @ spin pump inlet | 299° C. |
| Pump Dowtherm temperature | 300° C. |
| Pot Dowtherm temperature | 300° C. |
| Quench | |
| Type | Radial inflow |
| Delay length | 57.2 mm |
| Housing diameter | 224.5 mm |
| Housing length | 405 mm |
| Flow rate | 31.5 m$^3$/m |
| Lube roll speed | 4.5 rpm |
| Undrawn speed | 1650 m/m |
| Draw ratio #1 | 1.73 |
| #2 | 1.42 |
| #3 | 0.98 |
| #4 (to winder) | 0.979 |
| TOTAL | 2.357 |
| Roll Temperature | |
| Feed | 100° C. |
| lst draw | AMB/AMB |
| 2nd draw | 200/200° C. |
| Conditioning | 150/150° C. |
| DPL Steam Jet (2nd draw zone) | |
| Pressure | 41.4 newtons/cm$^2$ |
| Temperature | 420° C. |
| Compaction | |
| Pressure | 41.4 newtons/cm$^2$ |
| Winder | |
| Type | A4 Rieter |
| Tension | 200 qms |
| Take-up speed | 3888.9 mpm |

TABLE III

| | |
|---|---|
| Number of Filaments | 300 |
| Throughput, Lbs/Hr | 36.8 |
| Undrawn Speed, mpm | 1000 |
| Draw Ratio #1 | 1.60 |
| Draw Ratio #2 | 1.58 |
| Draw Ratio #3 (to Winder) | 1.00 |

TABLE III-continued

| | |
|---|---|
| Total | 2.528 |
| Roll Surface ($R_a$), Microinches | |
| Feed | 2–8 |
| lst Draw | 35–43/44–53 |
| 2nd Draw | 63–66/70–77 |
| Roll Temperature, °C. | |
| Feed | 100/100 |
| lst Draw | 100/100 |
| 2nd Draw | 200/200 |
| Winder | |
| Type | Leesona 968 |
| Tension, Grams | 100 |
| Take-up Speed, mpm | 2528 |
| Yarn Properties | |
| Denier | 1045 |
| Elongation, % | 13.2 |
| Break Strength, Lbs. | 18.3 |
| Tenacity, gpd | >0.96 |
| Shrinkage, % | 2.1 |
| Intrinsic Viscosity | — |
| COOH | — |
| Mechanical Quality | |
| Defects/1000 m | 3.2 |
| Visual Rating | Excellent |
| Second Stage Draw Tension, Grams | >5000 (Estimated 6000) |

TABLE IV

| | |
|---|---|
| Number of Filaments | 300 |
| Throughput, Lbs/Hr | 41.4 |
| Undrawn Speed, mpm | 1100 |
| Draw Ratio #1 | 1.73 |
| Draw Ratio #2 | 1.46 |
| Draw Ratio #3 | 0.99 |
| Draw Ratio #4 (to Winder) | 1.00 |
| Total | 2.501 |
| Roll Surface ($R_a$), Microinches | |
| Feed | 2–8 |
| lst Draw | 2–8 |
| 2nd Draw | 35–43/44–53 |
| Conditioning | 63–66/70–77 |
| Roll Temperature, °C. | |
| Feed | 100 |
| lst Draw | 57 |
| 2nd Draw | 210/210 |
| Conditioning | 100/100 |
| Steam Jet | |
| Pressure, Newtons/cm$^2$ | 55.1 |
| Temperature, °C. | 311/418 |
| Winder | |
| Type | Leesona 968 |
| Tension, gm | 100 |
| Take-up Speed, mpm | 2751 |
| Yarn Properties | |
| Denier | 1005 |
| Elongation, % | 9.6 |
| Breaking Strength, Lbs | 18.8 |
| Tenacity, gpd | 8.50 |
| Shrinkage, % | 5.9 |

Mechanical Quality

| Steam Jet Temperature, °C. | Second Stage Draw Tension, Grams | Defects/ 1000 m | Visual Rating |
|---|---|---|---|
| 418 | 2800 | 100 | Substandard |
| 425 | 2900 | 60 | Substandard |
| 410 | 2800 | 92 | Substandard |
| 393 | 2800 | 91 | Substandard |
| 378 | 2900 | 60 | Substandard |
| 369 | 3000 | 53 | Substandard |
| 361 | 2900 | 87 | Substandard |
| 353 | 3000 | 75 | Substandard |
| 347 | 3000 | 76 | Substandard |
| 335 | 3000 | 105 | Substandard |
| 333 | 3000 | 88 | Substandard |
| 322 | 3000 | 80 | Substandard |
| 311 | 3000 | 102 | Substandard |

TABLE V

| | |
|---|---|
| Number of Filaments | 300 |
| Throughput, Lbs/Hr | 36.8 |
| Undrawn Speed, mpm | 1000 |
| Draw Ratio #1 | 1.73 |
| Draw Ratio #2 | 1.47 |
| Draw Ratio #3 (to Winder) | 1.00 |
| Total | 2.543 |
| Roll Surface, Microinches | |
| Feed | 2–8/2–8 |
| lst Draw | 35–43/44–53 |
| 2nd Draw | 63–66/70–77 |
| Roll Temperature, °C. | |
| Feed | 100/100 |
| lst Draw | 100/100 |
| 2nd Draw | 200/200 |
| DPL Steam Jet | |
| Pressure, Newtons/cm$^2$ | 41.4 |
| Temperature, °C. | 328–424 |
| Winder | |
| Type | Leesona 968 |
| Tension, Grams | 150 |
| Take-up Speed, mpm | 2543 |
| Yarn Properties | |
| Denier | 1002 |
| Elongation, % | 14.5 |
| Breaking Strength, Lbs. | 18.5 |
| Tenacity, gpd | 8.38 |
| Shrinkage, % | 2.1 |

Mechanical Quality

| Steam Jet Temperature, °C. | Second Stage Draw Tension, Grams | Defects/ 1000 Meters | Visual Rating |
|---|---|---|---|
| 328 | — | 2 | Excellent |
| 330 | 3000 | 6 | Excellent |
| 330 | — | 10 | Excellent |
| 332 | — | Adjusted 60 dpl | Substandard |
| 332 | — | 3 | Excellent |
| 332 | — | 2 | Excellent |
| 331 | — | 2 | Excellent |
| 331 | — | 2 | Excellent |
| 331 | — | 13 | Excellent |
| 352 | — | 21 | Excellent |
| 354 | — | 12 | Excellent |
| 353 | — | 6 | Excellent |
| 375 | — | 4 | Excellent |
| 375 | — | 2 | Excellent |
| 375 | — | 2 | Excellent |
| 390 | — | 4 | Excellent |
| 390 | — | 13 | Excellent |
| 406 | — | 13 | Excellent |
| 407 | — | 9 | Excellent |
| 407 | — | 6 | Excellent |
| 425 | — | 3 | Excellent |
| 424 | 2900 | 3 | Excellent |

TABLE VI

| Process Conditions | |
|---|---|
| Yarn denier | 1000 |
| Filaments | 290 |
| Thruput | 51.8 kg/hr |
| Polymer temperature @ spin pump inlet | 299° C. |
| Pump Dowtherm temperature | 300° C. |
| Pot Dowtherm temperature | 300° C. |
| Quench | |
| Type | Radial inflow |
| Delay length | 57.2 mm |
| Housing diameter | 224.5 mm |
| Housing length | 405 mm |
| Flow rate | 31.5 m$^3$/m |
| Lube roll speed | 4.5 rpm |
| Undrawn speed | 1650 m/m |

TABLE VI-continued

| Process Conditions | |
|---|---|
| Draw ratio #1 | 1.73 |
| #2 | 1.42 |
| #3 | 0.98 |
| #4 (to winder) | 0.979 |
| TOTAL | 2.357 |
| Roll Temperature | |
| Feed | 100° C. |
| lst draw | AMB/AMB |
| 2nd draw | 200/200° C. |
| Conditioning | 150/150° C. |
| DPL Steam Jet (2nd draw zone) | |
| Pressure | 41.4 newtons/cm$^2$ |
| Temperature | 420° C. |
| Compaction | |
| Pressure | 41.4 newtons/cm$^2$ |
| Winder | |
| Type | A4 Rieter |
| Tension | 200 gms |
| Take-up speed | 3888.9 mpm |

TABLE VII

DRAWN FIBER PROPERTIES

| Run Number | DEN* | UE* | UTS* | BS* | TS* | UE + TS |
|---|---|---|---|---|---|---|
| 1 | 999 | 9.5 | 8.25 | 18.18 | 6.2 | 15.7 |
| 2 | 1005 | 10.2 | 8.33 | 18.45 | 6.0 | 16.2 |
| 3 | 1007 | 9.8 | 8.13 | 18.05 | 5.4 | 15.2 |
| 4 | 998 | 9.9 | 8.22 | 18.09 | 5.9 | 15.8 |

| Run Number | IV* | COOH* | Oil, % |
|---|---|---|---|
| 1 | 0.903 | 26.0 | 0.34 |
| 2 | 0.900 | 26.0 | 0.28 |
| 3 | 0.900 | 27.3 | 0.26 |
| 4 | 0.900 | 26.1 | 0.29 |

*DEN is denier
UE* is ultimate elongation, %
UTS* is ultimate tensile strength, g/d
BS* is breaking strength, lbs
TS* is ASTM shrinkage measured at 177° C., %
COOH* is carboxyl end groups, meq/kg
Undrawn Properties
Birefringence
N = 0.0284

We claim:

1. In a high speed process to produce high performance, multi-end, polyester tire and industrial yarn comprising a. extruding molten polyester from a spinnerette to form filaments, then b. cooling, lubricating and advancing said filaments to a first forwarding roll system at a speed of from about 1000 to 4000 meters per minute so that a partially oriented yarn is produced, then c. feeding said filaments so that the filaments are partially drawn from said forwarding roll system to a first draw roll system, then d. feeling the partially drawn yarn from said first draw roll system to a second draw roll system having a draw point localizing device, then e. feeding said filaments from said second draw roll system to a conditioning roll system, and finally f. taking-up said filaments, the improvement comprising use of matte finish godet rolls having an arithmetic mean roll surface roughness value of from between about 35 microinches and about 120 microinches to feed and withdraw yarn to and from a draw point localizing device in said second draw roll system, so that the tension in the second draw zone is maintained below 5 gpd and more than one end of said filaments can be advanced through a single set of forwarding, drawing and conditioning rolls and yarn mechanical quality remains at a high level of acceptance.

2. The process of claim 1 wherein the tension in the second draw zone is maintained at 4 gpd or less.

3. The process of claim 2 wherein the tension in the second draw zone is maintained below 3.5 gpd.

4. The process of claim 3 wherein the roughness value is between about 35 and about 80 microinches.

5. The process of claim 4 wherein the second stage draw roll system is four matte finish godet rolls paired in a first pair to feed the draw point localizing device and a second pair to withdraw yarn from the draw point localizing device.

6. The process of claim 5 wherein the first pair of draw rolls are maintained at a temperature of from between about 50° to about 100° C. and the second pair of draw rolls are maintained at a temperature of from between about 200° to 237° C.

7. The process of claim 6 wherein the conditioning roll system is a pair of godet rolls maintained at a temperature of from about 140° to 160° C.

8. The process of claim 7 wherein said conditioning rolls have an arithmetic mean roll surface roughness value of from between about 35 and 120 microinches.

9. The process of claim 7 wherein the conditioning rolls have a roughness value of from between about 35 and 80 microinches.

10. The process of claim 8 wherein the localizing device is a steam jet operating at a steam temperature of from between about 320° and 520° C. and the yarn speed on the first forwarding roll system is from between about 1200 and 3000 m/m.

11. The process of claim 10 wherein said first forwarding roll system has a roughness value of from between about 2 and 8 microinches, and is maintained at a temperature of between from about 80° C.-100° C.

12. The process of claim 9 wherein the yarn relaxes from between about 1 to 10 percent on said conditioning roll system.

* * * * *